US005289870A

United States Patent [19]

Dierbeck

[11] Patent Number: 5,289,870

[45] Date of Patent: Mar. 1, 1994

[54] MOUNTING ASSEMBLY FOR A MODULAR HEAT EXCHANGER

[76] Inventor: Robert F. Dierbeck, 2707 Hall Rd., Hartford, Wis. 53027

[21] Appl. No.: 6,785

[22] Filed: Jan. 21, 1993

[51] Int. Cl.[5] ..... F28F 9/04

[52] U.S. Cl. ..... 165/76; 165/178

[58] Field of Search ..... 165/76, 81, 82, 178

[56] References Cited

U.S. PATENT DOCUMENTS

| | | | |
|---|---|---|---|
| 2,969,956 | 1/1961 | Forgo | 165/82 X |
| 2,995,342 | 8/1961 | Quattrini | 165/82 |
| 3,792,729 | 2/1974 | Perry | 165/76 |
| 5,042,572 | 8/1991 | Dierbeck | 165/76 |

FOREIGN PATENT DOCUMENTS

| | | | |
|---|---|---|---|
| 191441 | 8/1957 | Austria | 165/82 |

*Primary Examiner*—Allen J. Flanigan

*Attorney, Agent, or Firm*—Andrus, Sceales, Starke & Sawall

[57] ABSTRACT

An assembly for mounting a plurality of modular heat exchangers between respective pairs of fluid openings in parallel opposed faces of an inlet header and an outlet header, including modules providing generally axial flow between the headers, each of which modules has an axially extending sleeve defining a fluid opening on one end and an end flange defining a fluid opening on the opposite end, and an end chamber having an axially flexible end wall and forming a connection between either or both of the end sleeve and the end flange and the heat exchanging portion of the module, the assembly including compressible sealing members attached to the end sleeve and the end flange and compression type mounting brackets by which the sealing members are compressed to seal the interface and provide a demountable connection between the module and the headers.

7 Claims, 3 Drawing Sheets

MOUNTING ASSEMBLY FOR A MODULAR HEAT EXCHANGER

BACKGROUND OF THE INVENTION

The present invention pertains to a mounting assembly for a replaceable heat exchanger module and, more particularly, to a mounting assembly for axially flexible heat exchanger modules which accommodates axial movement of the module during installation and as a result of thermal expansion and contraction during use.

U.S. Pat. Nos. 4,979,560, 4,981,170 and 5,042,572 disclose various heat exchanger constructions, all of which are adapted to be made in a modular form in a manner in which they are separately and easily demountable from an array of such modules for replacement. A heat exchanger unit utilizing an array of such modules is particularly attractive for use as a radiator in the cooling system of a large vehicle, such as a truck or an off-the-road construction vehicle. Such vehicles are not only more susceptible to cooling system damage because of the environments in which they operate, but vehicle downtime is usually extremely critical and costly. The above identified patents describe modular heat exchange units which, if damaged in use, can be initially shunted out of the cooling system until a replacement module is available without taking the vehicle out of operation. A damaged module is easily removable and the replacement module may be as easily installed in a simple, fast and cost effective manner.

In accordance with an improved mounting assembly disclosed in U.S. Pat. application Ser. No. 986,988, filed Dec. 8, 1992, a rubber vibration damper and shock load absorber is positioned between the axially flexible portion of each heat exchanger module and the mounting bracket by which the module is attached to a common cooling fluid header. The rubber cushioning means dampens the transmission of vibrations from the heat exchanger frame to the module and prevents excessive deflection of the module under severe external structural loads imposed on the frame, while allowing the necessary axial movement of the module to accommodate mounting and thermal expansion.

SUMMARY OF THE INVENTION

In accordance with the present invention, a modified mounting assembly for replaceable heat exchanger modules utilizes a prior art connector on one end of the module, such as the connector disclosed in U.S. Pat. No. 5,042,572, and a new connector of somewhat simplified construction on the other end of the module, designed particularly to be used in cooperation with the prior art connector. The modified connector of the present invention also requires slight modification of the end of the module on which it is utilized and also requires a somewhat modified mounting sequence.

The module utilizing the improved mounting assembly of the present invention is of the type providing generally axial through-flow of a heat exchanging fluid between module inlet and outlet openings on opposite ends of the module which are disposed in fluid communication with corresponding openings in inlet and outlet headers between which the module is connected. The mounting assembly includes an end flange on one end of the module defining either the inlet or outlet opening, which flange is larger than and overlies the header opening, and an axially extending cylindrical sleeve on the other end of the module defining the other of the inlet and outlet openings, which sleeve is adapted to fit into the other header opening. A first mounting bracket is attached to the header for the flanged end of the module and defines a slot for receipt of the flange for attaching the module to that header. A first compressible seal is positioned between the flange and around the edge of the header opening to which it is attached. The opposite sleeve end of the module is provided with a second compressible seal positioned to surround the sleeve and to engage the edge of the other header opening when the module end sleeve is inserted therein. At least one end of the module includes an end chamber by which the module is connected to either the end flange or the end sleeve and which chamber includes an enclosing wall which is flexible in the axial direction of fluid flow to accommodate axial elongation (or contraction) of the module. Means are also provided for compressing the first and second seals to seal the seal/-header interface and provide a demountable connection therebetween.

In accordance with the preferred embodiment of the improved mounting assembly, a second mounting bracket is attached to the header opening adapted to receive the module end sleeve, the second mounting bracket surrounding the header opening and defining a slot for receipt of the end sleeve and the second compressible seal surrounding the sleeve. The means for compressing the first and second seals preferably comprises a first wedge which is insertable into the slot between the first mounting bracket and the module end flange, and a second wedge which is insertable into the slot between the second mounting bracket and the second compressible seal around the module end sleeve.

The second compressible seal includes a rigid annual retainer which surrounds the end sleeve and is positioned between the second compressible seal and the second wedge. The annual retainer is preferably cup-shaped and includes an outer peripheral lip which prevents radial outward expansion of the second seal during compression thereof.

The mounting assembly of the present invention is particularly adapted for use in a modular heat exchanger of the type having a generally rectangular supporting frame, inlet and outlet headers on opposite sides of the frame, which headers have opposed spaced parallel surfaces, each surface having a series of fluid openings which define opposed pairs of fluid openings between which a heat exchange module is connected to provide a parallel array of modules within the frame. Each module includes fluid conducting and heat exchanging conduit means extending axially between and attached at opposite ends to a pair of end plates, and an end wall secured along its outer edge to the outer edge of each end plate to form therewith an end chamber with at least one of the end walls being flexible to allow the end chamber formed thereby to be axially expandable. One of the end walls has a centrally attached flange which defines a first chamber opening corresponding to one of the pair of fluid openings in a header and the other of which end walls has a centrally attached axially extending sleeve defining a second chamber opening which is adapted to fit into the other of the pair of header openings. A first compressible seal is positioned between the module end flange and the header surface surrounding the fluid opening therein, and a second compressible seal surrounds the axially extending sleeve on the other end of the module and is disposed in contact with the header surface surrounding the other header fluid opening when the sleeve is inserted in that opening. Mounting bracket means are attached to each of the headers in alignment with the fluid openings in the header surfaces, the bracket means defining with the header surfaces a series of first mounting slots for receiving the flange and seal on the common ends of the modules which include said first chamber openings and a series of second mounting slots for receipt of the sleeve and seal on the opposite ends of the modules which includes the second chamber openings. A pressure wedge is slidably insertable into each first slot between the bracket means and the flange and into each second slot between the bracket means and the second compressible seal to compress the seals and attach the module ends to the headers.

Preferably, the mounting bracket means includes a channel-shaped bracket for each header fluid opening, each of which brackets includes a pair of legs joined by an integral center plate with the free ends of the legs secured to the header surface on opposite sides of the fluid openings. The center plate of each bracket has an open portion for receipt, respectively, of the flange and first compressible seal on one end of the module and the sleeve and the second compressible seal on the other end of the module. Each second compressible seal is provided with a rigid annular retainer which is positioned between the pressure wedge and the compressible seal, as defined with respect to the first identified embodiment above.

DETAILED DESCRIPTION OF THE PREFERRED EMBODIMENT

Figure 1:
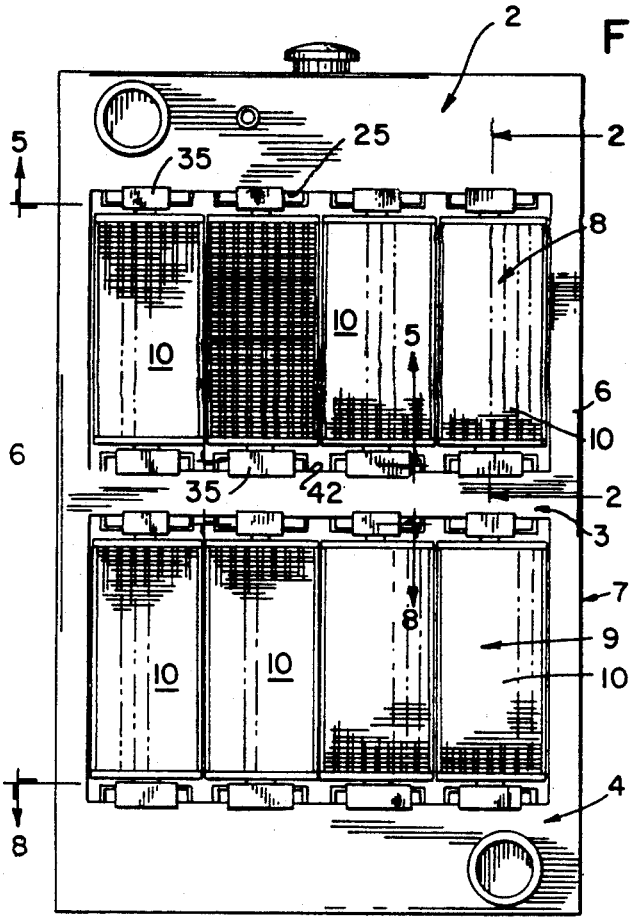
FIG. 1 is a front elevation of a heat exchanger utilizing replaceable modules attached with the mounting assembly of the present invention.

Referring to FIG. 1, a modular heat exchanger 986,988, filed Dec. 8, 1992, a rubber vibration 1 includes an upper inlet header 2, intermediate header 3 and lower outlet header 4 all tied together by a pair of side frame members 6 to form a generally rectangular supporting frame 7. In the heat exchanger construction shown, upper and lower parallel arrays 8 and 9 of heat exchanger modules 10 are disposed in two tiers separated by the intermediate header 3. Each of the headers 2, 3 and 4 has a substantially open interior for the fluid flowing into or out of the modules 10. If an individual module 10 is damaged so that fluid is escaping from the system, that module is simply replaced by utilizing the mounting assembly and procedure to be described and a replacement module 10 attached in its place.

Figure 3:
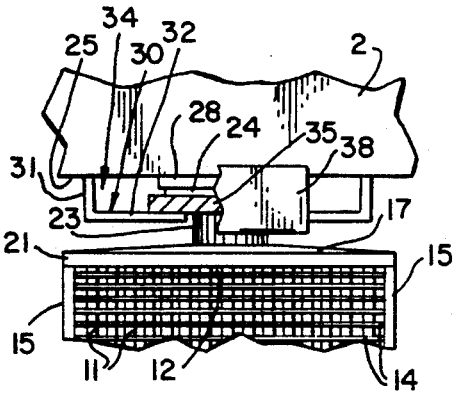
FIG. 3 is a front elevation of a portion of one end of a heat exchanger module utilizing a prior art connector.
Figure 4:
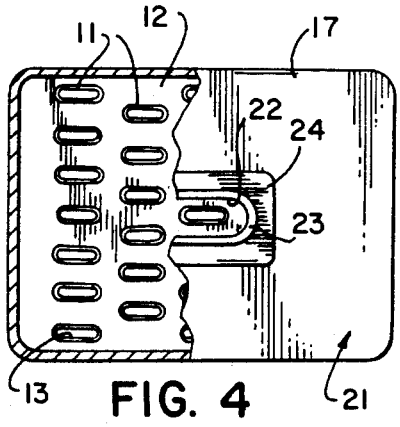
FIG. 4 is a sectional view taken on line 4—4 of FIG. 2 through the end of the module utilizing the prior art connector.
Figure 2:
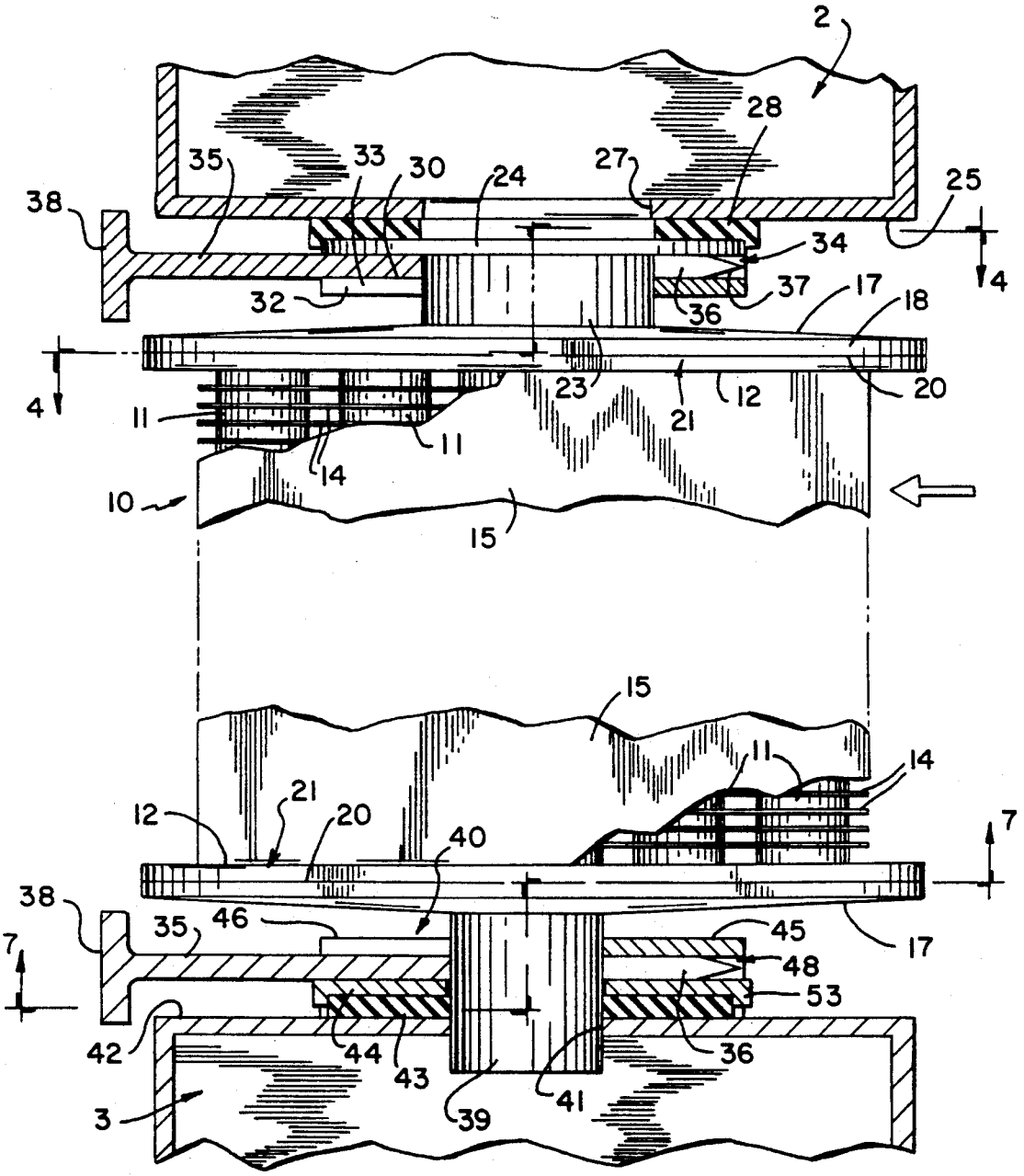
FIG. 2 is an enlarged sectional view taken on line 2—2 of FIG. 1.
Figure 5:
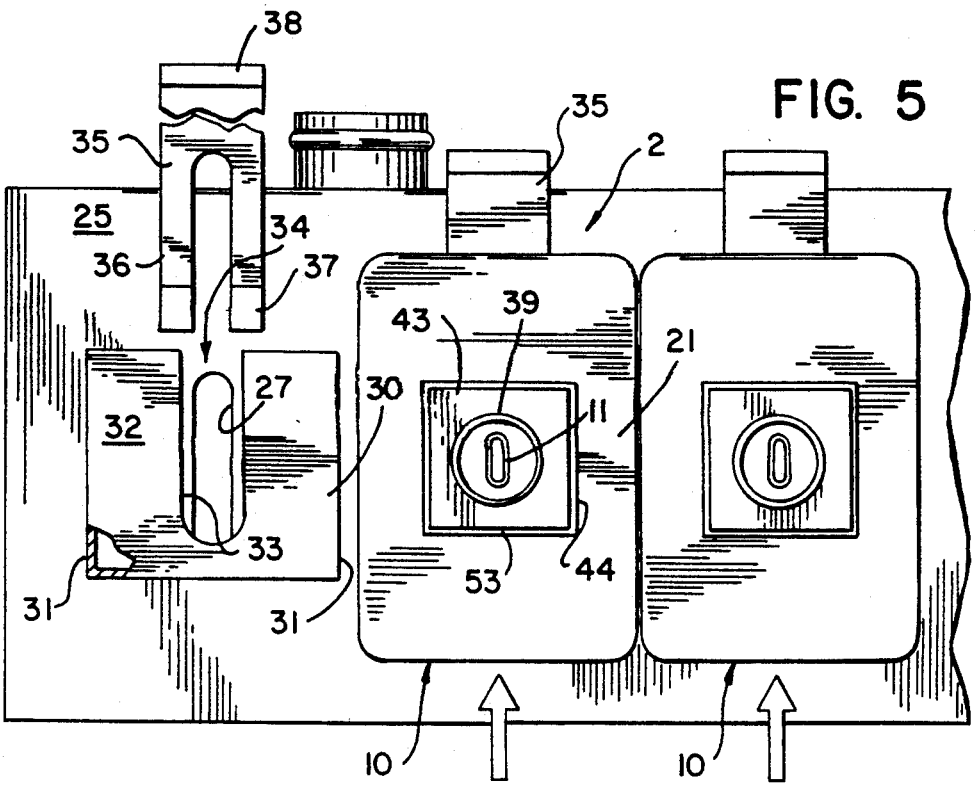
FIG. 5 is a bottom plan view of a common inlet header showing details of a portion of the mounting assembly combining features of the prior art and of the present invention.

Referring to also FIGS. 2–4, the mounting assembly of the present invention is shown with heat exchanger modules 10 utilizing conventional tube and header construction. Each module 10 includes a series of tubular conduits 11 which extend in a generally parallel orientation between a pair of end plates 12. Each end plate is provided with a pattern of holes 13, each of which holes is adapted to receive one end of a tubular conduit 11 which is rigidly secured therein with a soldered or brazed connection, all in a well known manner. A multiplicity of fairly densely packed heat exchanging fins 14 are attached to the tubular conduits between the end plates 12, also in a known manner. The tube and fin assembly may be supported on opposite faces by a pair of side plates 15, but the module 10 is open in a direction parallel to the side plates to allow cooling air to flow readily over the tubes and fins generally in the direction of the arrows in FIGS. 5 and 6.

Each end plate 12 has its peripheral edge upturned in a direction away from the module to form a peripheral lip 16. The end plates are relatively stiff and such stiffness is substantially enhanced by the rigid soldered connections of the multiple tubular conduits 11. A thin flexible end wall 17 is attached by its outer peripheral edge to the peripheral lip 16 of the end plate 12. Each end wall 17 may include a peripheral outer flange 18 for direct attached to the lip 16 of the end plate, as with a soldered, brazed or welded seam 20. The connected end plate 12 and end wall 17 form chambers 21 on each end of the module 10.

The mounting assembly of the present invention utilizes a prior art connector on one end which is of the type disclosed in U.S. Pat. No. 5,042,572, and a modified connector of the present invention on the opposite end.

Thus, the end wall 17 which utilizes the prior art connector is provided with a central opening 22 which is defined by an axially extending sleeve 23. The opposite end of the sleeve 23 has attached thereto a mounting end flange 24. The mounting flange 24 is adapted to overlie the bottom surface 25 of the inlet header 2 such that the central opening 22 to the chamber 21 is aligned with the outlet opening 27 from the header 2. A continuous compressible sealing member 28 overlies the outer face of the mounting flange 24.

The inlet header 2 is provided with a series of outlet openings 27 and a mounting bracket 30 is attached to the bottom surface 25 of the header at each fluid opening. Each of the mounting brackets 30 has a generally channel shape when viewed in FIG. 3 and includes a pair of parallel side flanges 31 secured to the header surface and an integral center plate 32 extending between the side flanges 31. The center plate 32 is provided with a U-shaped notch 33 large enough to allow the sleeve 23 on the end wall 17 to extend therein. The interior of the mounting bracket 30 and the bottom surface 25 of the header define a mounting slot 34 into which the mounting flange 24 and sealing member 28 may be slid as the sleeve 23 is received in the U-shaped notch 33.

A wedge 35 is then slidably inserted into the mounting slot 34 between the inside surface of the center plate 32 and the surface of the mounting flange 24 opposite the sealing member 28 to compress the sealing member against the header surface 25 and secure the module thereto. The wedge 35 is bifurcated to define a pair of legs 36 which straddle the sleeve 23 as the wedge is inserted into the mounting slot 34. The remote ends 40 of the legs 36 are tapered to facilitate initial insertion of the legs between the mounting brackets 30 and the mounting flange 24. The wedge may also be provided with a flanged handle 38 to facilitate manual insertion and removal of the wedge.

The modified connector assembly 40 of the present invention is utilized to attach the opposite end of the module 10 to the other header, such as the intermediate header 3, and to seal the interface therebetween so as to prevent leakage of cooling fluid. It is to be understood that attachment of a module 10 as part of an upper array 8 between headers 2 and 3, or as part of a lower array 9 between headers 3 and 4, utilizes a combination of one prior art connector, previously described, and a modified connector assembly 40 of the present invention and either of said connectors can comprise the upper connection with the other comprising the lower. Also, the connector pair may be utilized as well in a heat exchanger in which the modules 10 are disposed horizontally between laterally spaced headers.

Figure 7:
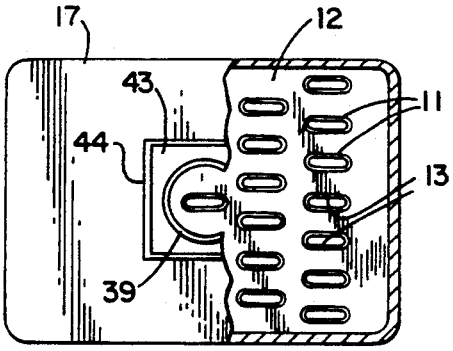
FIG. 7 is a sectional view taken on line 7—7 of FIG. 2 showing the end of the module utilizing the mounting assembly of the present invention.
Figure 6:
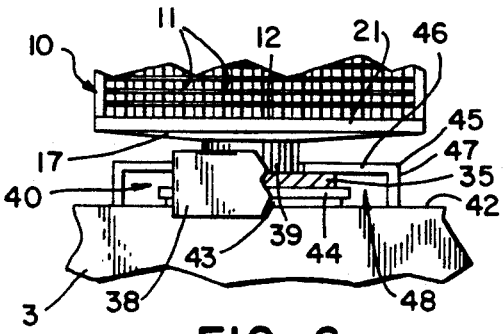
FIG. 6 is a front elevation similar to FIG. 3 showing a portion of the opposite end of the module utilizing the mounting assembly of the present invention.
Figure 8:
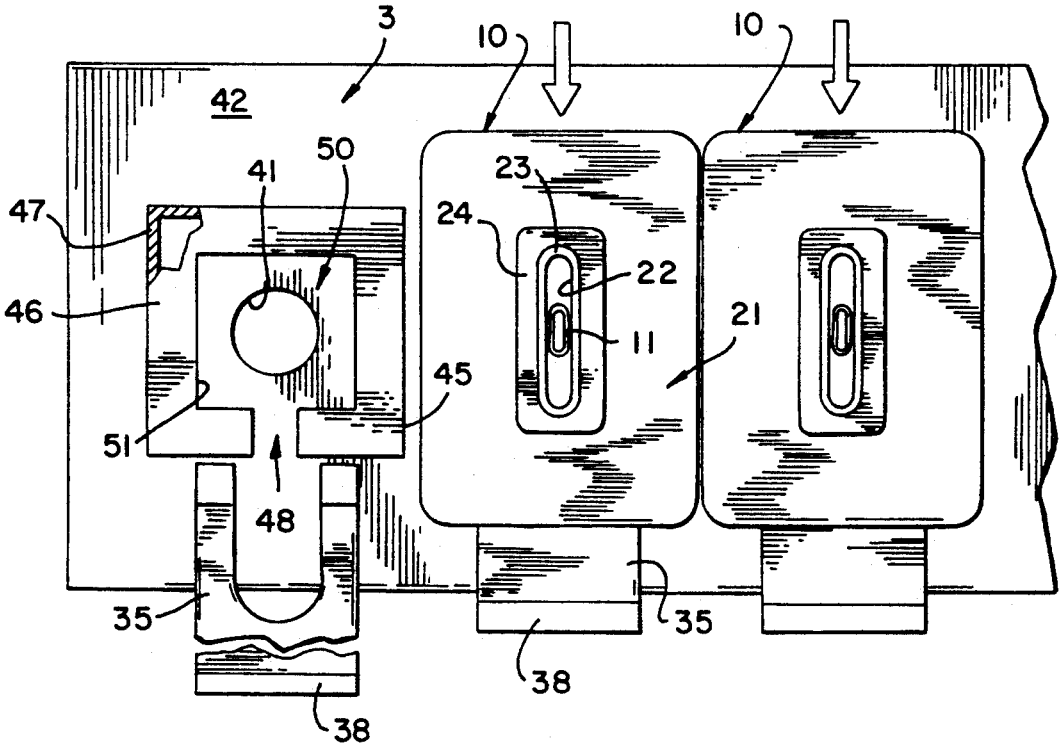
FIG. 8 is similar to FIG. 5 and is a top plan view of a common outlet header showing portions of the module mounting assembly including features of prior art connector and the connector of the present invention.

Referring also to FIGS. 6–8, the end of the module to which the modified connector assembly 40 is attached includes a modified type of axially extending sleeve 39 utilized on the opposite end of the module having the prior art connector. The sleeve 39 for connector assembly 40 is cylindrical and does not have an end flange 24 and is sized to fit into an inlet opening 41 in the top face 42 of the intermediate header 3 (or into a similar opening in either of the other headers 2 or 4). A compressible annular sealing member 43 is placed around the sleeve 39 and positioned to bear against the face 42 of the header around the inlet opening 41 when the sleeve is inserted therethrough. The compressible sealing member 43 is preferably held in an annular cup-shaped retainer 44 which is also placed over the sleeve 39 with the sealing member. A mounting bracket 45, similar to prior art mounting bracket 30, has a channel-shaped construction including a center plate 46 extending between a pair of side flanges 47 by which the bracket is attached to the header. The interior of the mounting bracket 45 forms with the header face 42 a mounting slot 48.

The annular sealing member 43 and its cup-shaped retainer 44 may be attached to the module end sleeve 39 during installation of the module in either of two manners and, as a result, an open portion 50 in the bracket center plate 46 may be shaped differently to accommodate the specific mounting method and, in either case, may be different than the U-shaped notch 33 in the prior art mounting bracket 30. On the other hand, the construction of the specific mounting bracket 45 used with the connector assembly 40 could be used in place of the prior art mounting bracket 30.

In accordance with the preferred method of installation, the center plate 46 of the mounting bracket 45 is provided with a modified U-shaped notch 51 which includes an enlarged center portion 52. The annular sealing member 43 and its retainer 44 are slid onto the end sleeve 39 of the module prior to connection. The enlarged center portion 52 in the mounting bracket center plate 46 is large enough to allow the module sleeve with the sealing member and retainer attached thereto to be inserted through the mounting bracket from the outside as the sleeve 39 is inserted into the inlet opening 41 in the header 3. Alternately, the subassembly of the sealing member 43 and annular retaining ring 44 could be slid laterally into the mounting slot 48 and aligned with the header opening 41, and the sleeve 39 of the module inserted simultaneously through the U-shaped notch 51, the annular retainer 44, sealing member 43 and header inlet opening 41. In utilizing such an alternate installation procedure, the notch 51 in the bracket would not require the enlarged center portion 52, but rather could be made like the mounting bracket 30 of the prior art. Indeed, to accommodate axial insertion of the module end sleeve 39, either with or without the seal and retainer attached, the center plate of the mounting bracket need only be provided with a hole, rather than a U-shaped notch.

Once the sleeve 39 is positioned in the header inlet opening 41 and the compressible annular sealing member 43 is positioned adjacent the face 42 of the header, a wedge 35, identical to that used in the prior art connector, is inserted into the mounting slot 48 between the center plate 46 and the annular retainer 44, resulting in compression of the sealing member 43 around the module end sleeve 39 and against the face 42 of the header. The outer peripheral rim 53 of the cup-shaped retainer 44 prevents radial outward expansion of the sealing member 43 during installation compression thereof and helps clamp the compressible seal tightly around the module sleeve 39. The cylindrical shape of the module end sleeve 39 prevents the sleeve from being crushed by the radial clamping force imposed on the sealing member 43.

The heat exchanger module 10 is preferably installed between two headers, such as the upper inlet header 2 and the intermediate header 3 as follows. The end of the module having the sleeve 39, with the sealing member 43 and annular retainer 44 mounted thereon, is inserted through the enlarged center portion 52 in the center plate 46 of the mounting bracket, so that the end of the sleeve 39 passes through the header opening 41 and into the header until the compressible seal 43 contacts the header face 42. Because the space between opposing faces 25 and 42 of the headers interconnected by the module is less than the overall length thereof, the module 10 will initially have to be inserted through the mounting bracket 45 with the module axis inclined slightly with respect to the axis of the aligned openings 27 and 41 in the headers. Once the end sleeve 39 has been inserted far enough into the header 3, the end flange 24 and sealing member 28 on the opposite end of the module can be swung substantially horizontally into the mounting slot 34 in the other mounting bracket 30, as previously described. The wedge 35 for that mounting bracket is then inserted into the mounting slot 34 between the end flange 24 and the center plate 32 to secure that end of the module in position. Another wedge 35 is then inserted into the mounting slot 48 on the other end of the module, between the center plate 46 of the mounting bracket 45 and the retainer 44 to secure that end of the module in position and complete the assembly. The compression of the annular sealing member 43, caused by insertion of the wedge 35, causes the sealing member to seal the header opening 41 and to tighten securely around the sleeve 39 of the module and grip the same with a fluid-tight seal.

The inherent flexibility of the end walls 17 forming one wall of the chambers 21 on each end of the module will accommodate axial elongation of the module during installation, as well as substantial axial movement of the module in operation as a result of thermal stresses, blows to the heat exchanger frame, or a twisting thereof resulting from movement of the vehicle frame to which the heat exchanger may be attached.

Various modes of carrying out the present invention are contemplated as being within the scope of the following claims particularly pointing out and distinctly claiming the subject matter which is regarded as the invention.

I claim:

1. A mounting assembly for a replaceable heat exchanger module of the type providing generally axial through-flow of a heat exchanging fluid between opposite inlet and outlet openings, said mounting assembly comprising:

an inlet header and an outlet header having, respectively, a header outlet opening and a header inlet opening;

said module including opposite end chambers for said outlet openings;

one of the inlet and outlet openings on one of said module end chambers defined by an end flange larger than the corresponding one of said header inlet and outlet openings, and the other of said module inlet and outlet openings defined by an axially extending end sleeve adapted to fit into the other of said header inlet and outlet openings;

a first mounting bracket attached to said one header surrounding the header opening therein and defining a slot for receipt of the end flange for attaching the module to said one header, and a first compressible seal positioned between the end flange and the peripheral edge of said one header opening;

a second compressible seal surrounding said end sleeve and positioned to engage the peripheral edge of said other header opening when said end sleeve is disposed therein;

a second mounting bracket attached to said other header surrounding the header opening therein and defining a slot for receipt of the end sleeve and second compressible seal; and, a first wedge insertable into the slot between the first mounting bracket and the end flange, and a second wedge insertable into the slot between the second mounting bracket and the second compressible seal for compressing said first and second seals to seal the interface and provide a demountable connection between the module and the headers.

2. The mounting assembly as set forth in claim 1 wherein said second compressible seal includes a rigid annular retainer surrounding said end sleeve and positioned between said second seal and said second wedge.

3. The mounting assembly as set forth in claim 2 wherein said annular retainer is cup-shaped and includes an outer peripheral lip to prevent radially outward expansion of said second seal during compression thereof.

4. The mounting assembly as set forth in claim 1 wherein one of said end chambers includes an enclosing wall which is flexible in the axial direction of fluid flow to accommodate axial elongation of the module.

5. A mounting assembly for a modular heat exchanger comprising:

a generally rectangular supporting frame;

an inlet header and an outlet header on opposite sides of the frame;

the headers having opposed spaced parallel surfaces, each surface having a series of fluid openings defining opposed pairs of fluid openings in said surfaces;

a heat exchanger module interconnecting each opposed pair of fluid openings to provide a parallel array of modules within the frame;

each module including fluid conducting and heat exchanging conduit means extending axially between and attached at opposite ends to a pair of end plates, an end wall secured along its outer edge to the outer edge of each end plate to form therewith an end chamber, at least one of said end walls being flexible to allow the end chamber formed thereby to be axially expansible;

one of said end walls having a centrally attached flange defining a first chamber opening corresponding to one of said pair of fluid openings and the other of said end walls having a centrally attached axially extending sleeve defining a second chamber opening, said sleeve adapted to fit into the other of said pair of fluid openings;

a first compressible seal positioned between said flange and the header surface surrounding said one fluid opening, and a second compressible seal surrounding said axially extending sleeve and in contact with the header surface surrounding said other fluid opening when said sleeve is disposed in said opening;

mounting bracket means attached to each of the headers in alignment with the series of fluid openings in the header surface, said bracket means defining with the header surfaces a series of first mounting slots for receipt of the flange and seal on the common ends of the modules including said first chamber openings and a series of second mounting slots for receipt of the sleeve and seal on the opposite ends of the modules including said second chamber opening; and, a pressure wedge slidably insertable into each second slot the bracket means and the flange and into each second slot between the bracket means and the second compressible seal to compress the seals and attach the module ends to the headers.

6. The mounting assembly as set forth in claim 5 wherein said mounting bracket means comprises:

a channel-shaped bracket for each header fluid opening, each bracket including a pair of side flanges joined by an integral center plate with the free ends of the legs secured to the header surface on opposite sides of the fluid opening; and, the center place of each bracket having an open portion for receipt respectively of the flange and first compressible seal on one end of the module and the sleeve and second compressible seal on the other end of the module.

7. The mounting assembly as set forth in claim 6 including a rigid annular retainer for said second seal, said retainer positioned between the pressure wedge and said second seal.

* * * * *